US008141255B2

(12) United States Patent
Su

(10) Patent No.: US 8,141,255 B2
(45) Date of Patent: Mar. 27, 2012

(54) MULTI-IMPACT HAND TOOL

(76) Inventor: Cheng-Wei Su, Taichung (TW)

( * ) Notice: Subject to any disclaimer, the term of this patent is extended or adjusted under 35 U.S.C. 154(b) by 307 days.

(21) Appl. No.: 12/550,367

(22) Filed: Aug. 29, 2009

(65) Prior Publication Data

US 2011/0047803 A1 Mar. 3, 2011

(51) Int. Cl.
*B25D 3/00* (2006.01)
*B25D 1/16* (2006.01)

(52) U.S. Cl. ..... 30/167; 30/277; 173/90

(58) Field of Classification Search ..... 30/164–173, 30/335, 277; 173/90, 202, 211, 203, 91, 173/170; 81/27, 463; 144/195.5, 195.7
See application file for complete search history.

(56) References Cited

U.S. PATENT DOCUMENTS

| | | | | |
|---|---|---|---|---|
| 5,040,614 | A * | 8/1991 | Nash | 172/18 |
| 5,819,856 | A * | 10/1998 | Meyer | 172/13 |
| 5,878,822 | A * | 3/1999 | Roy | 173/90 |
| 6,367,854 | B1 * | 4/2002 | Chou | 294/57 |
| 6,786,491 | B2 * | 9/2004 | Carbonneau | 279/89 |
| 7,293,361 | B1 * | 11/2007 | Miller | 30/164.6 |

* cited by examiner

*Primary Examiner* — Laura M. Lee

(57) ABSTRACT

A multi-impact hand tool comprises a sleeve, a tool head, a movable rod, a spring and an impact block. With only one impact operation, the multi-impact hand tool can provide a multi-impact effect, thus improving the working efficiency. In addition, the impact force can be directly transferred to the tool head for performing the chiseling operation, thus improving the working efficiency.

5 Claims, 7 Drawing Sheets

MULTI-IMPACT HAND TOOL

BACKGROUND OF THE INVENTION

1. Field of the Invention

The present invention relates to an impact hand tool, and more particularly to a multi-impact hand tool.

2. Description of the Prior Art

Referring to FIG. 1, a conventional multi-impact hand tool essentially comprises an impact rod 11 with a movable pipe 12 engaged thereon. Between the impact rod 11 and the movable pipe 12 is disposed an assistant impact assembly including an assembling block 13, a spring 14 and an impact block 15.

By such arrangements, the user can hold the movable pipe 12 with one hand while pulling the impact rod 11 with the other to move the impact block 15 away from the distal end 121 of the movable pipe 12, and subsequently releasing the impact rod 11 to allow it to drive the impact block 15 to impact against the distal end 121 of the movable pipe 12 to make the tool head 122 at the front end of the movable pipe 12 perform a chiseling operation. In addition, when the impact block 15 impacts against the distal end 121 of the movable pipe 12, a counterforce will be produced, which can cooperate with the elastic force of the spring 14 to make the impact block 15 impact against the distal end 121 of the movable pipe 12 continuously for many times, thus enhancing the working efficiency. However, the above conventional multi-impact hand tool suffers from the following drawbacks.

Between the impact rod 11 and the impact block 15 is disposed the spring 14, so that the end 111 of the impact rod 11 is not in a direct contact with the impact block 15. Therefore, during the impact process of the impact rod 11 and the impact block 15, the spring 14 will absorb a part of the impact force, so that the impact block 15 cannot transfer the full impact force to the impact block 15, thus reducing the chiseling force of the tool head 122.

The present invention has arisen to mitigate and/or obviate the afore-described disadvantages.

SUMMARY OF THE INVENTION

The primary objective of the present invention is to provide a multi-impact hand tool which can provide a multi-impact effect through only one impact operation to improve the working efficiency and can make the impact force be directly transferred to a tool head to perform the chiseling operation to improve the working efficiency.

Hence, in order to achieve the above objectives, a multi-impact hand tool in accordance with the present invention comprises a sleeve, a tool head, a movable rod, a spring and an impact block. The sleeve includes an axial hole including an open end and a closed end that are oppositely arranged. The tool head has one end connected to the closed end of the sleeve, and the other end of the tool head is a working end. The movable rod includes a handle and an assembling end that are oppositely arranged, the assembling end is interiorly formed with a groove including a limiting portion, and the assembling end of the movable rod is slidably disposed in the axial hole of the sleeve. The spring includes a first end and a second end that are oppositely arranged, the spring is slidably disposed in the axial hole of the sleeve and the groove of the movable rod, and the first end of the spring is located opposite the limiting portion of the groove of the movable rod. The impact block includes an end surface and an impact portion that are oppositely arranged, the impact block is slidably disposed in the axial hole of the sleeve and the groove of the movable rod, the end surface of the impact block is fixedly connected to the second end of the spring, and the impact portion is located opposite the closed end of the sleeve.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
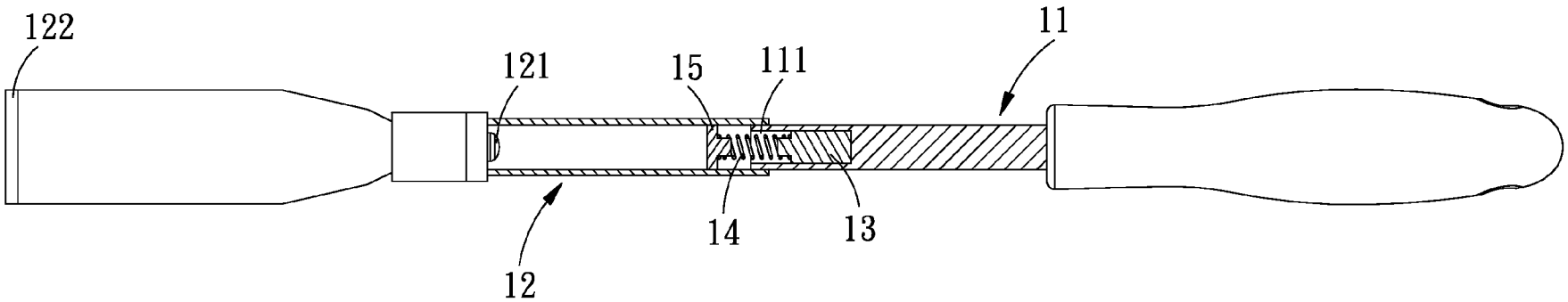
FIG. 1 PRIOR ART
FIG. 1 is a partial cross-sectional view of a conventional multi-impact hand tool.
Figure 2:
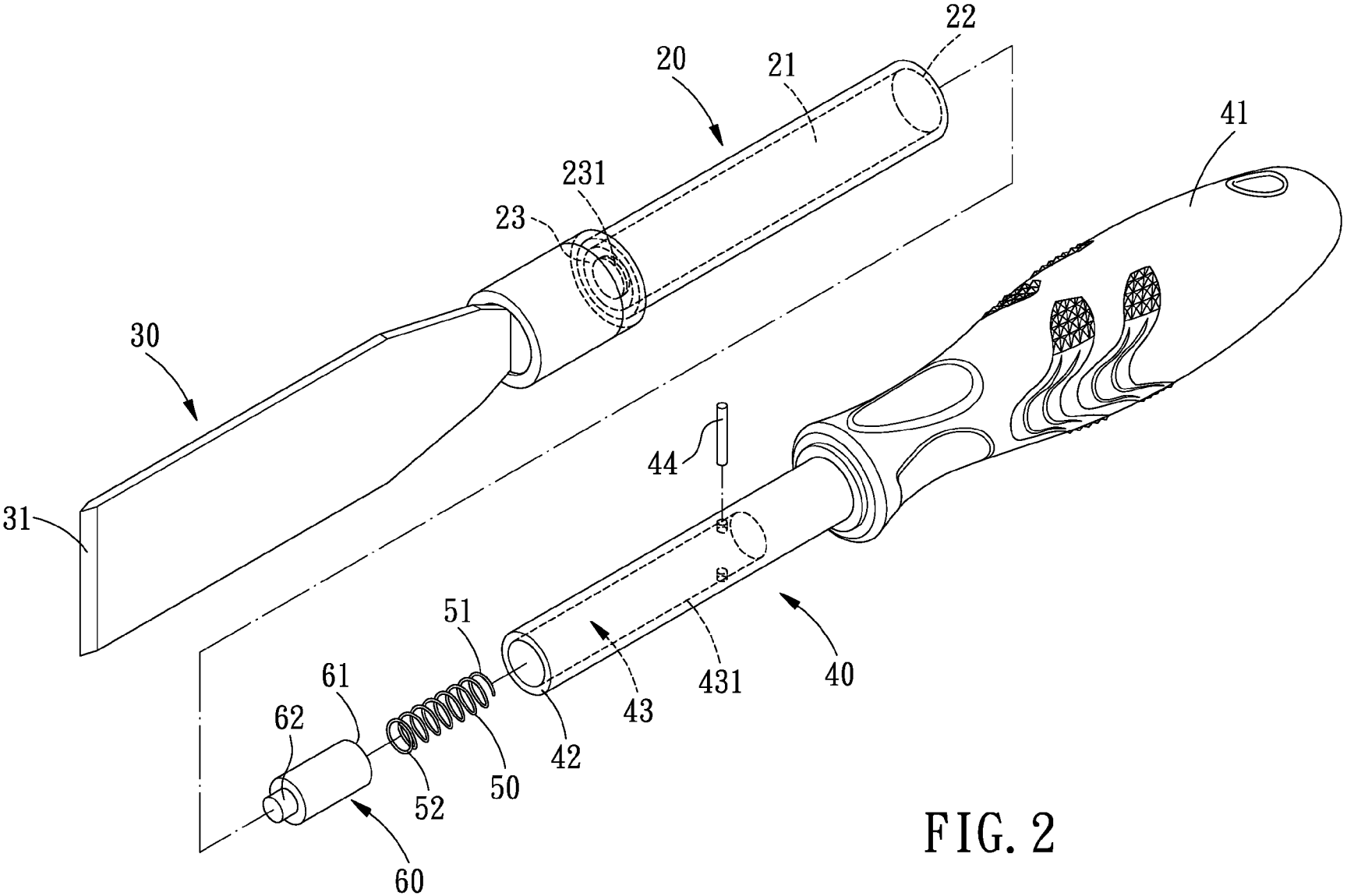
FIG. 2 is an exploded view of a multi-impact hand tool in accordance with the present invention.
Figure 3:
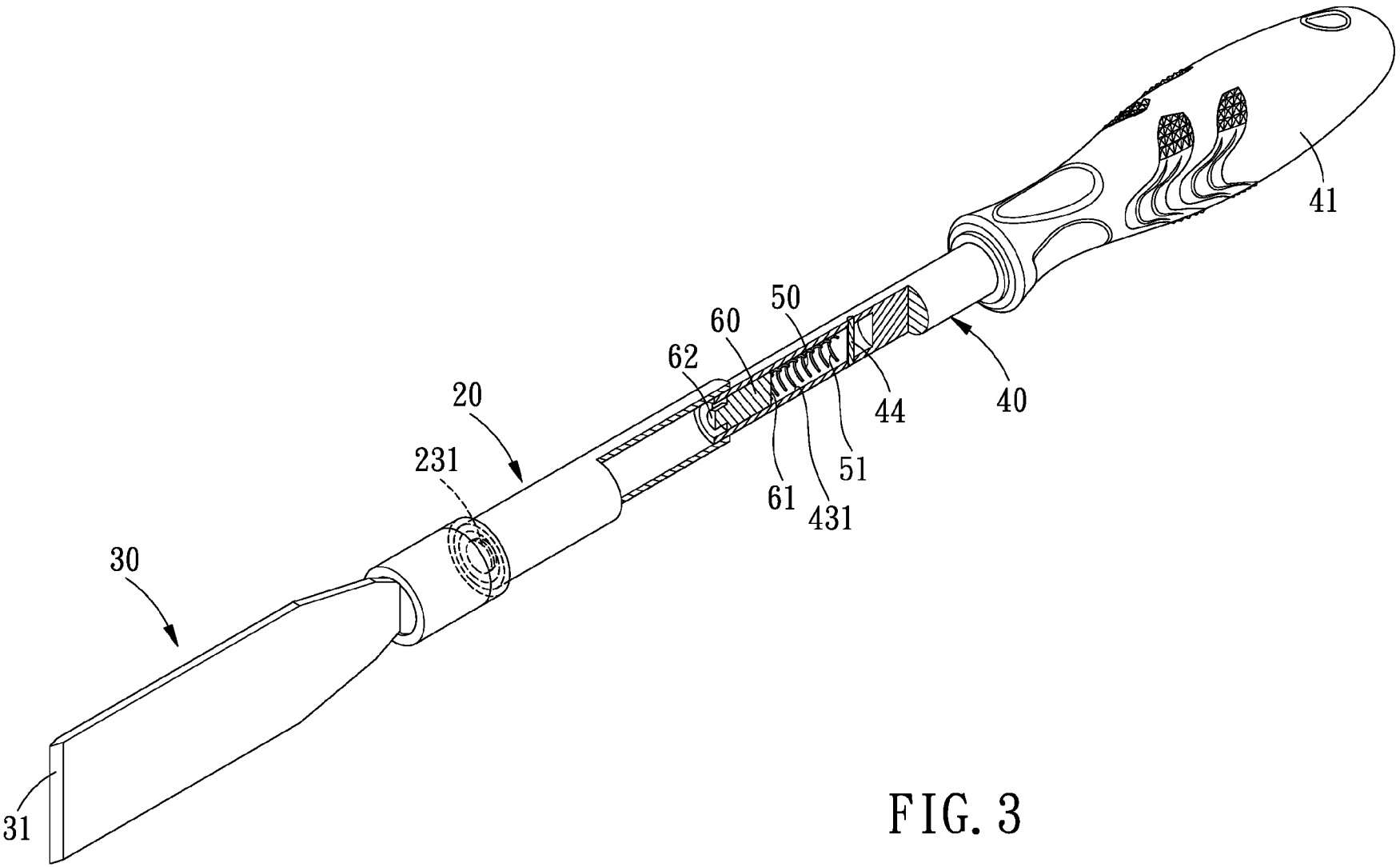
FIG. 3 is a partial cross-sectional view of the multi-impact hand tool in accordance with the present invention.
Figure 4:
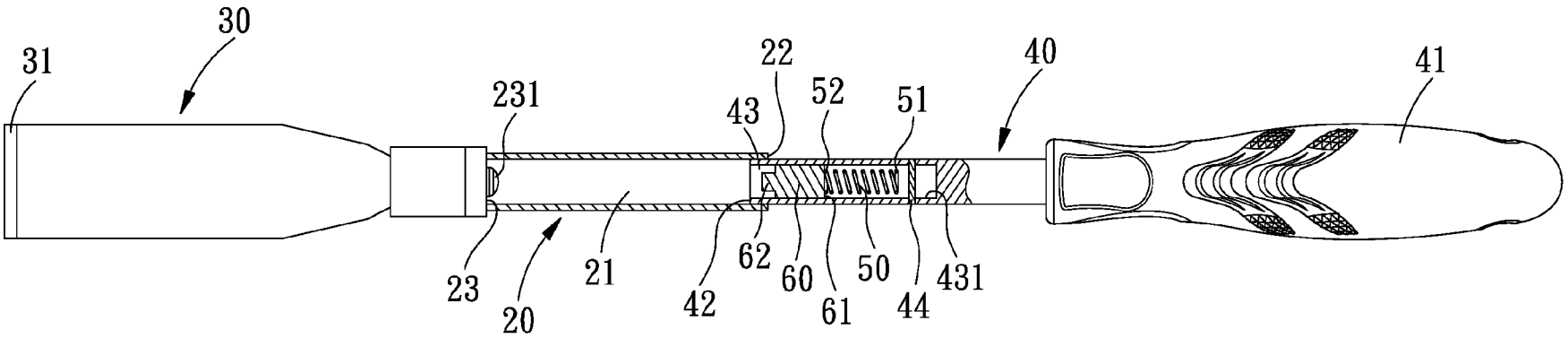
FIG. 4 is another partial cross-sectional view of the multi-impact hand tool in accordance with the present invention.

Referring to FIGS. 2-4, a multi-impact handle tool in accordance with a preferred embodiment of the present invention essentially comprises a sleeve 20, a tool head 30, a movable rod 40, a spring 50 and an impact block 60.

The sleeve 20 is a hollow structure defined with an axial hole 21. The axial hole 21 includes an open end 22 and a closed end 23 that are oppositely arranged. The closed end 23 seals an interior of the axial hole 21 and is centrally formed with a protrusion 231 protruding toward the open end 22.

The tool head 30 has one end connected to the closed end 23 of the sleeve 20, and the other end of the tool head 30 is a working end 31. The working end 31 is formed into a desired shape, and in the present embodiment, it is formed into a flat chisel.

The movable rod 40 includes a handle 41 to be held by the user and an assembling end 42 that are oppositely arranged. The assembling end 42 is interiorly defined with a groove 43 including a limiting portion, and the limiting portion in the present embodiment is a bolt 44 both ends of which are inserted through a peripheral surface 431 of the groove 43. The assembling end 42 of the movable rod 40 is slidably disposed in the axial hole 21 of the sleeve 20 in such a manner that the groove 43 is in communication with the axial hole 21.

The spring 50 includes a first end 51 and a second end 52 that are oppositely arranged. The spring 50 is slidably disposed in the axial hole 21 of the sleeve 20 and the groove 43 of the movable rod 40, and the first end 51 of the spring 50 is located opposite the bolt 44 in the groove 43.

The impact block 60 includes an end surface 61 and a cylindrical impact portion 62 that are oppositely arranged. The impact block 60 is slidably disposed in the axial hole 21 of the sleeve 20 and the groove 43 of the movable rod 40. The end surface 61 is fixedly connected to the second end 52 of the spring 50, and the impact portion 62 is located opposite the protrusion 231 of the closed end 23 of the sleeve 20.

The aforementioned is the summary of the positional and structural relationship of the respective components of the preferred embodiment in accordance with the present invention.

Figure 5:
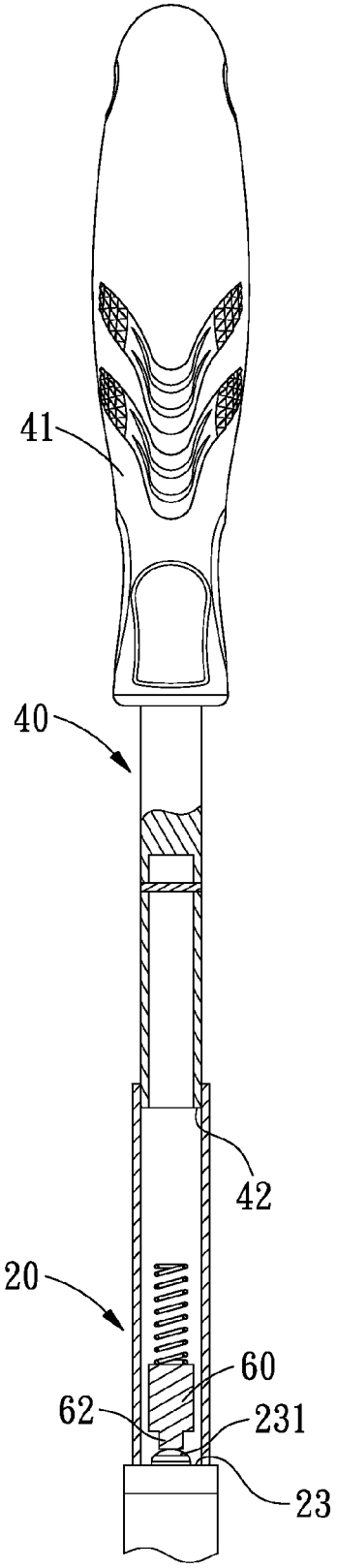
FIG. 5 is an operational view of the multi-impact hand tool in accordance with the present invention, showing the assembling end of the movable rod is moved away from the closed end of the sleeve.
Figure 6:
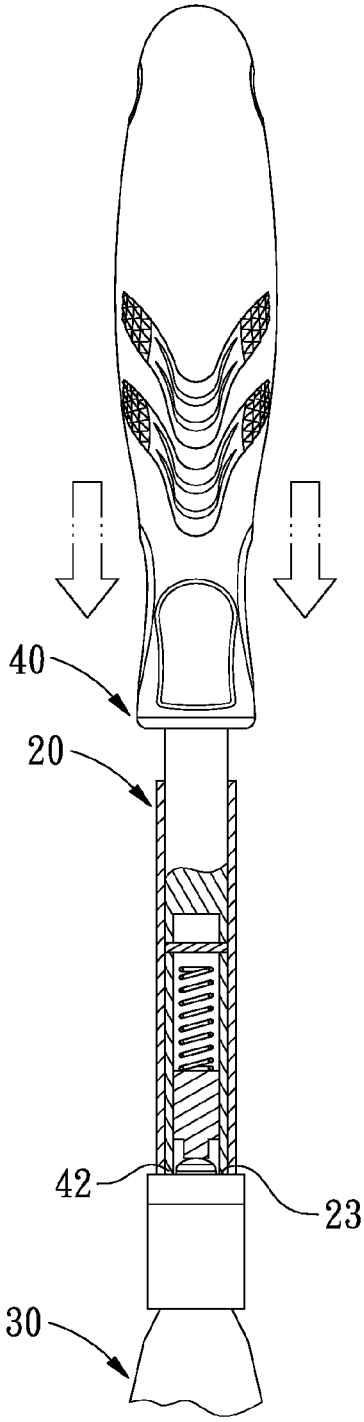
FIG. 6 is an operational view of the multi-impact hand tool in accordance with the present invention, showing the assembling end of the movable rod directly impacts against the closed end of the sleeve.

For a better understanding of the present invention, its operation and function, reference should be made to FIGS. 5-6:

Referring to FIG. 5, the user holds the sleeve 20 with one hand while holding the handle 41 of the movable rod 40 and pulling the movable rod 40 to move the assembling end 42 of the movable rod 40 away from the closed end 23 of the sleeve 20 with the other, at this moment, the impact portion 62 of the impact block 60 is in contact with the protrusion 231 of the closed end 23.

Referring to FIG. 6, the user releases the movable rod 40 to make it fall freely by gravity or by applying a downward force, and when the assembling end 42 of the movable rod 40 impacts against the closed end 23 of the sleeve 20, the impact force of the movable rod 40 will be directly transferred to the working end 31 of the tool head 30 to perform a first chiseling operation.

Figure 7:
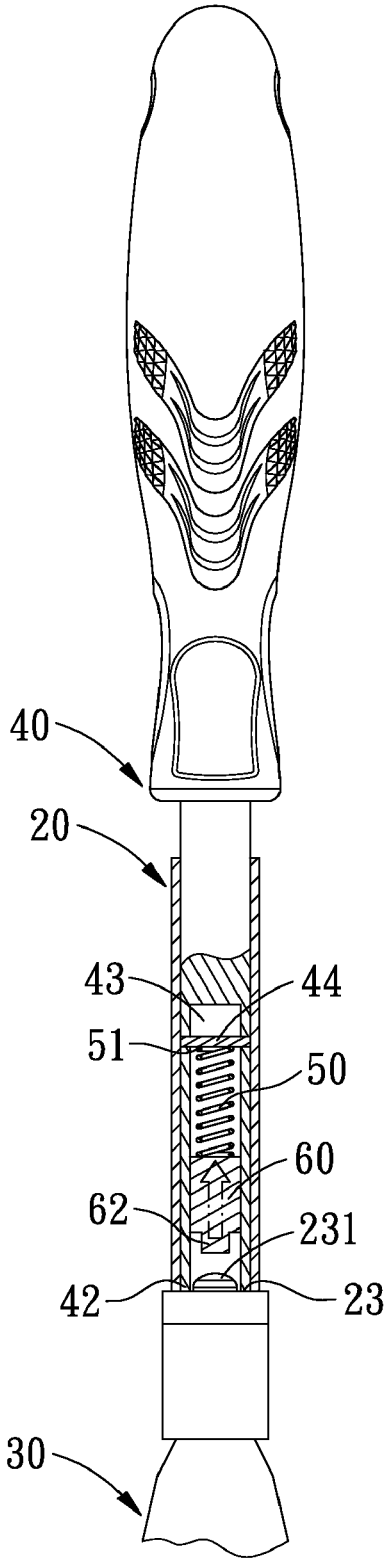
FIG. 7 is an operational view of the multi-impact hand tool in accordance with the present invention, showing that the spring is compressed by the impact block.

Referring to FIG. 7, after the assembling end 42 of the movable rod 40 impacts against the closed end 23 of the sleeve 20, an impact force will be produced to separate the impact portion 62 of the impact block 60 away from the protrusion 231 of the closed end 23 and makes the impact block 60 together with the spring 50 slide toward the bolt 44 of the groove 43. During the sliding process of the impact block 60, and after the first end 51 of the spring 50 is stopped against by the bolt 44, the impact block 60 will compress the spring 50 under the effect of inertia.

Figure 8:
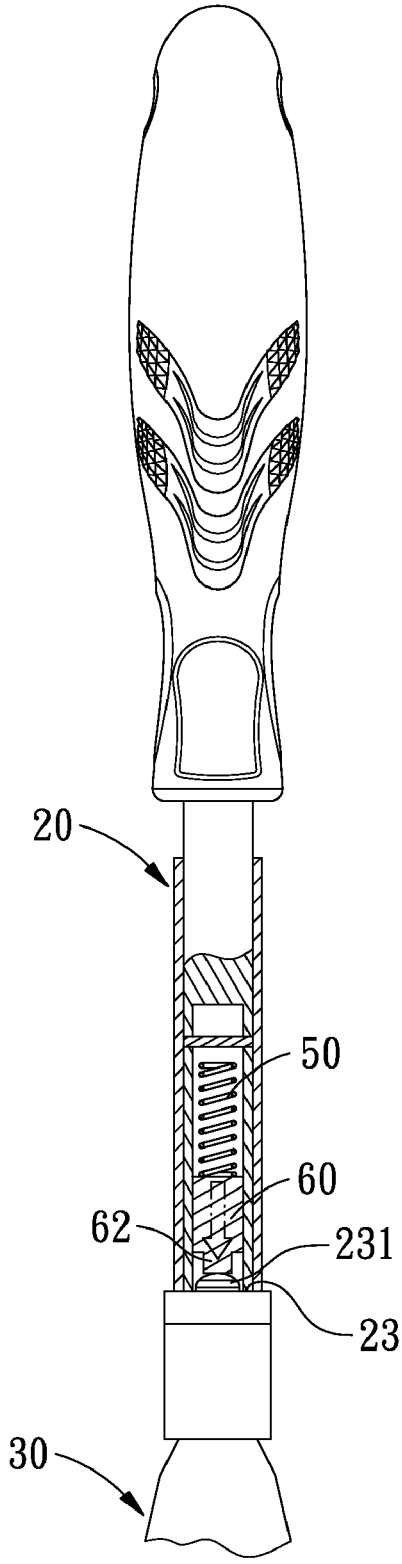
FIG. 8 is an operational view of the multi-impact hand tool in accordance with the present invention, showing the impact block impacts against the protrusion of the closed end of the sleeve.

Subsequently, referring to FIG. 8, the elastic restoring force of the spring 50 will force the impact block 60 to move toward the closed end 23 of the sleeve 20, and then the impact portion 62 of the impact block 60 will impact against the protrusion 231 of the closed end 23, and the impact force of the impact block 60 will be directly transferred to the working end 31 of the tool head 30 by the closed end 23 to perform a second chiseling operation.

Finally, after the impact block 60 impacts against the protrusion 231 of the closed end 23, under the effect of the counterforce and the inertia of the impact block 60, the spring 50 will be compressed by the impact block 60 again to separate the impact block 60 away from the protrusion 231 of the closed end 23 temporarily, and the elastic restoring force of the compressed spring 50 will also make the impact block 60 impact against the protrusion 231 of the closed end 23 to make the tool head 30 perform a third chiseling operation. Hence, the impact block 60 will impact against the protrusion 231 of the closed end 23 continuously for many times until the impact block 60 stops.

As known from the above description, when the present invention performs the first chiseling operation, the assembling end 42 of the movable rod 40 is in a direct contact with the closed end 23 of the sleeve 20, therefore, the impact force of the movable rod 40 is directly transferred to the tool head 30 to indeed improve the chiseling efficiency. In addition, between the sleeve 20 and the movable rod 40 are disposed the spring 50 and the impact block 60, so that the user can obtain a multi-impact effect with only one impact operation, thus improving the working efficiency.

Figure 9:
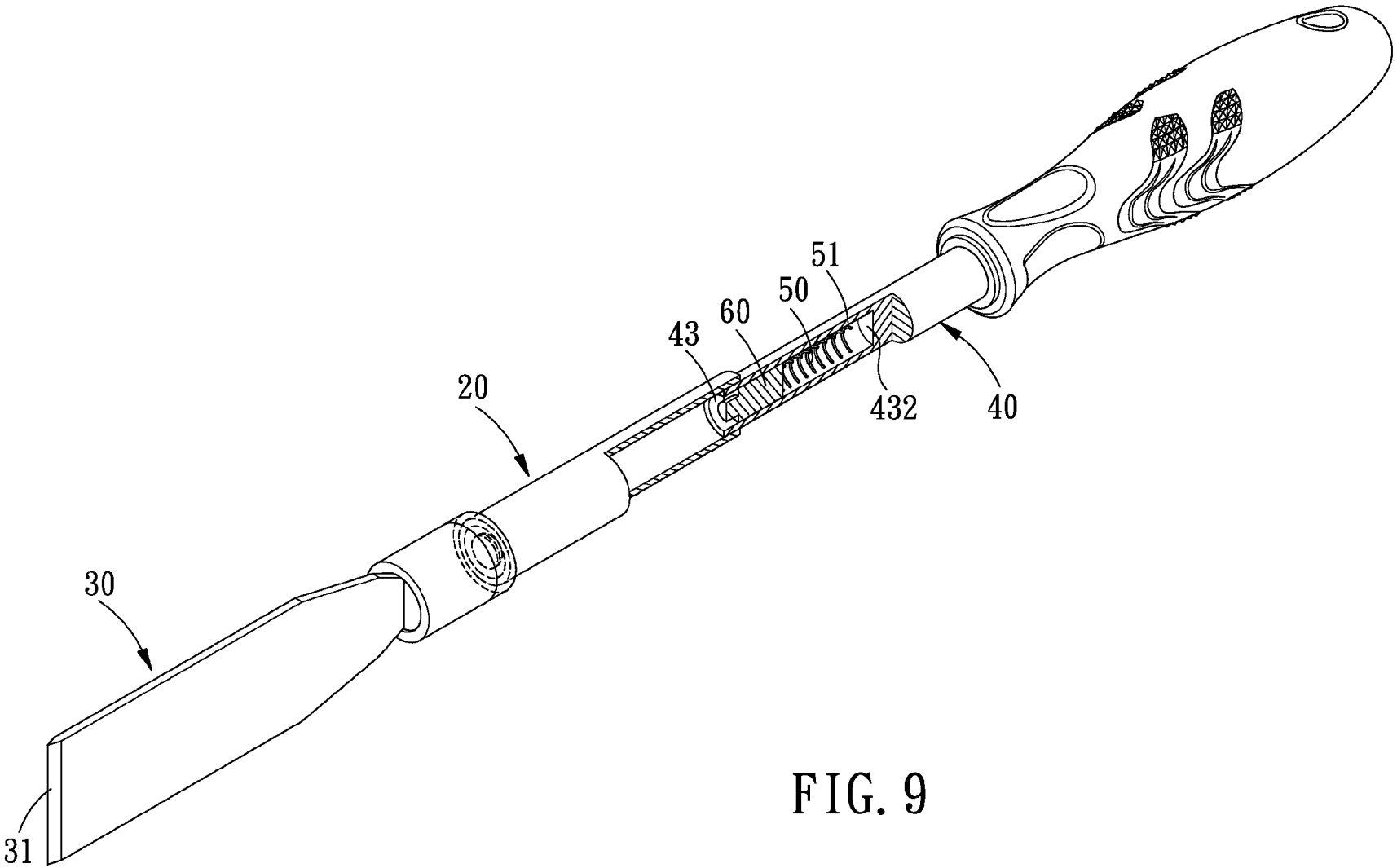
FIG. 9 is a partial cross-sectional view of the multi-impact hand tool in accordance with the present invention, showing the limiting portion of the movable rod is a bottom surface of the groove.

It is to be noted that, the limiting portion of the movable rod 40 of the present invention can be, as shown in FIG. 3, the bolt 44 both ends of which are inserted through the peripheral surface 431 of the groove 43, or it can also be, as shown in FIG. 9, a bottom surface 432 of the groove 43 to which the first end 51 of the spring 50 is fixedly connected.

While we have shown and described various embodiments in accordance with the present invention, it is clear to those skilled in the art that further embodiments may be made without departing from the scope of the present invention.

What is claimed is:

1. A multi-impact hand tool comprising:

a sleeve including an axial hole, and the axial hole including an open end and a closed end that are oppositely arranged;

a tool head having one end connected to the closed end of the sleeve, and the other end of the tool head being a working end;

a movable rod including a handle and an assembling end that are oppositely arranged, the assembling end being interiorly formed with a groove including a limiting portion, the assembling end of the movable rod being slidably disposed in the axial hole of the sleeve;

a spring disposed in a space formed by the axial hole of the sleeve and the groove of the movable rod; and an impact block including an end surface and an impact portion that are oppositely arranged, the impact block being slidably disposed in the axial hole of the sleeve and the groove of the movable rod, the multi-impact hand tool being characterized in that: the spring has a first end which is a free end located toward the limiting portion of the groove of the movable rod, and a second end of the spring is fixed to the end surface of the impact block, the spring being slidable within the groove until abutment of the free end with the limiting portion restricts the sliding movement of the spring towards the working end and sliding movement towards the closed end moves the free end away from the limiting portion; when the movable rod moves downward, the assembling end of the movable rod will impact the closed end, producing an impact force to bring the impact block and the spring out of contact with the closed end, making the impact block and the spring move in the space formed by the axial hole of the sleeve and the groove of the movable rod, then an elastic force of the spring will make the impact block and the spring bounce back and forth repeatedly between the closed end and the limiting portion, and as a result, the impact block will repeatedly impact the closed end of the sleeve, driving the tool head.

2. The multi-impact hand tool as claimed in claim 1, wherein the limiting portion of the movable rod is a bolt, both ends of which are inserted through a peripheral surface of the groove of the movable rod.

3. The multi-impact hand tool as claimed in claim 1, wherein the limiting portion of the movable rod is a bottom surface of the groove of the movable rod.

4. The multi-impact hand tool as claimed in claim 1, wherein the sleeve is centrally formed with a protrusion protruding toward the open end, and the protrusion is located opposite to the impact portion of the impact block.

5. The multi-impact hand tool as claimed in claim 1, wherein the working end of the tool head is a flat chisel.

* * * * *